US012396600B2

(12) United States Patent
Wetzer et al.

(10) Patent No.: US 12,396,600 B2
(45) Date of Patent: Aug. 26, 2025

(54) FLUID DOSING SUBSTRATE DISPENSER

(71) Applicant: Dual Strategies, LLC, Tampa, FL (US)

(72) Inventors: Michael Wetzer, Tampa, FL (US); Anthony DeMore, Cleveland, OH (US)

(73) Assignee: Dual Strategies, LLC, Tampa, FL (US)

( * ) Notice: Subject to any disclaimer, the term of this patent is extended or adjusted under 35 U.S.C. 154(b) by 311 days.

(21) Appl. No.: 18/161,466

(22) Filed: Jan. 30, 2023

(65) Prior Publication Data

US 2023/0172403 A1 Jun. 8, 2023

Related U.S. Application Data

(63) Continuation-in-part of application No. 18/161,259, filed on Jan. 30, 2023, now Pat. No. 12,042,100, which is a continuation of application No. 17/194,098, filed on Mar. 5, 2021, now Pat. No. 11,672,383.

(51) Int. Cl.
*A47K 10/38* (2006.01)

(52) U.S. Cl.
CPC ..... *A47K 10/38* (2013.01); *A47K 2010/389* (2013.01)

(58) Field of Classification Search
CPC ..... A47K 20/10328; A47K 10/38; A47K 10/3612; A47K 10/3656; A47K 2010/3273; A47K 2010/3286; A47K 2010/3266
See application file for complete search history.

(56) References Cited

U.S. PATENT DOCUMENTS

| | | | | |
|---|---|---|---|---|
| 3,460,509 | A | 8/1969 | Kaczeus | |
| 3,707,945 | A | 1/1973 | Boone | |
| 5,803,397 | A | 9/1998 | Chang | |
| 6,457,434 | B1 | 10/2002 | Lazar | |
| 7,056,385 | B2 | 6/2006 | Likosar | |
| 7,318,949 | B2 | 1/2008 | Shadrach | |
| 8,231,076 | B2 * | 7/2012 | Troutman | A47K 10/36 242/563.2 |

(Continued)

FOREIGN PATENT DOCUMENTS

| | | | |
|---|---|---|---|
| EP | 1938726 | B1 | 9/2010 |
| GB | 1370633 | A | 10/1974 |

(Continued)

*Primary Examiner* — Patrick H Mackey
(74) *Attorney, Agent, or Firm* — Renner, Otto, Boisselle & Sklar, LLP

(57) ABSTRACT

A fluid dosing substrate dispenser comprises a housing with a first fluid reservoir and/or a first fluid reservoir holder configured to removably receive the first fluid reservoir and a second fluid reservoir and/or a second fluid reservoir holder configured to removably receive the second fluid reservoir. The dispenser includes a substrate advancing mechanism configured to receive substrate from a substrate source and to advance a portion of the substrate through the housing and an application mechanism configured to apply fluid from at least one of the first fluid reservoir or the second fluid reservoir to one or more portions of the substrate. A computing system is configured to select at least one of amount of fluid for application, composition of fluid for application, or portion of the substrate the fluid is applied based on an input received by the computing system indicating the user of the substrate dispenser.

14 Claims, 12 Drawing Sheets

(56) References Cited

U.S. PATENT DOCUMENTS

| | | | | |
|---|---|---|---|---|
| 9,532,684 | B2 | 1/2017 | Hoefte | |
| 9,642,503 | B1 | 5/2017 | Troutman | |
| 9,801,506 | B2 | 10/2017 | Adriaenssens | |
| 10,064,525 | B2 | 9/2018 | Ader | |
| 10,285,544 | B2 | 5/2019 | Perlas | |
| 10,293,353 | B2 | 5/2019 | Casper | |
| 10,588,469 | B2 | 3/2020 | Borke | |
| 10,710,284 | B2 * | 7/2020 | Ushigome | B32B 29/04 |
| 2002/0187276 | A1 | 12/2002 | Zhang | |
| 2004/0211229 | A1 | 10/2004 | Ohyama | |
| 2007/0272701 | A1 | 11/2007 | Carlsson | |
| 2009/0031952 | A1 * | 2/2009 | Lazar | A47K 10/32 118/695 |
| 2010/0314429 | A1 | 12/2010 | Troutman | |
| 2020/0154957 | A1 | 5/2020 | Abraham | |
| 2020/0273318 | A1 * | 8/2020 | Lindstrom | G16H 40/20 |
| 2022/0023472 | A1 | 1/2022 | Claussner et al. | |
| 2022/0279988 | A1 | 9/2022 | Stanca et al. | |
| 2022/0330360 | A1 * | 10/2022 | Ophardt | G06K 7/10237 |
| 2022/0346605 | A1 | 11/2022 | Kramer | |
| 2023/0049047 | A1 | 2/2023 | Halil | |

FOREIGN PATENT DOCUMENTS

| | | | |
|---|---|---|---|
| GB | 2500282 | A | 9/2013 |
| KR | 101921835 | B1 | 11/2018 |
| KR | 101955933 | B1 | 3/2019 |
| KR | 1020200025490 | A | 3/2020 |
| WO | 2017158244 | A1 | 9/2017 |

* cited by examiner

FLUID DOSING SUBSTRATE DISPENSER

FIELD

The present disclosure relates to a device that can selectively dose a substrate with fluid as desired and dispense such dosed substrate.

BACKGROUND

Dosing of substrates with fluids is applicable in various contexts including commercial, industrial, and consumer contexts. Examples include dosing a paper substrate with ink for manufacturing labeling purposes. Another example may include dosing a reactive substrate with a fluid that causes the material combination to react for industrial applications.

Yet another example may include dosing a porous substrate with a liquid to assist in the effective application of the liquid to other surfaces. One illustrative example of this modality may be the dosing of substrates such as cloth or paper with cleaning and/or disinfecting fluids. Exposed surfaces need to be cleaned and disinfected to keep them safe. Spraying surfaces with disinfectant and wiping the surfaces clean with cloth or paper towels is a well-known method of cleaning. However, dealing with both a spray bottle and a towel or a roll of paper towels is not ideal, particularly in the professional cleaning context. The market has attempted to address these concerns by providing paper substrates that are pre-moistened with disinfectants or other fluids. People commonly refer to these pre-moistened substrates as wet wipes. Various wipe dispensing packages exist that store multiple wet wipes which can be dispensed one at a time by the user. Typically, the wipes are stored in the dispensing device pre-dosed with the fluid. The dispensing device substantially seals to prevent the fluid in the wet wipes from evaporating. This approach tends to be costly and limiting in terms of available options for both substrates and fluids.

The inventors of the invention disclosed herein have determined that the market, including potentially the commercial, industrial, and consumer markets, would benefit from a novel fluid dosing substrate dispenser as described herein.

SUMMARY

Challenges remain with conventional approaches. In the above exemplary context of wet wipes, for example, the conventional approach of storing multiple wet wipes in a sealed container has been satisfactory in some respects, but problems nonetheless remain. The most common problem that arises is the wet wipes drying out. This may occur when the devices or packaging does not seal properly because of failure in design or because of damage during transportation or storage. Drying out of the wet wipes may nevertheless occur over time even if the devices or packaging work properly.

Another common problem is that wipe saturation may not be uniform throughout the packaging and, thus, wipes at the bottom may tend to be wetter while wipes at the top may dry out. Moreover, wet wipes may attach to each other and become inseparable when a user seeks to remove one from the device or packaging; the user would get two or more wet wipes at once. This may be wasteful because wet wipes often cannot or should not go back in the device or packaging. As a result, the user goes through her supply of wet wipes faster than she otherwise should have.

Another common problem is that chemicals in the fluid used to pre-wet the wipes can evaporate such that the volume of the fluid is reduced, or eliminated, with the passage of time. This is particularly likely to occur in the common circumstance where the wipes are dispensed only occasionally and the wipe fluid thus has a relatively long residence time in the dispenser.

Another problem is that, over time, the fluid and the wipe substrate may chemically interact with each other in such a way that the efficacy of the wipe and/or the fluid is compromised. Again, this problem may be of particular concern in the case where the wipes have a relatively long residence time in the dispenser.

Another problem with typical wipe dispensing systems is that they lack flexibility in terms of the chemical formulations that can be employed. That is, typical wipe dispensing systems are constrained to a limited number of types of chemical formulations for the fluid, since the fluid is required to remain relatively efficacious over a long period of time and cannot have adverse interactions with the wipe substrate material. Corresponding restrictions are imposed on the wipes as well. That is, the wipes must be made of a substrate material that does not significantly degrade when exposed to the fluid for long periods of time.

Typical wipe dispensing packaging lack flexibility in other regards as well. For example, it is sometimes the case that a fluid combination is relatively more efficacious than its individual components considered separately. However, such fluid combinations may be efficacious for only a limited period of time. Consequently, it may not be practical to use wipes pre-dosed with such fluid combinations in typical wipe dispensing systems since the fluid on the wipe may reside in the dispensing system for a period of time longer than its useful life.

In light of problems such as those noted above, it would be useful to provide a wipe dispensing system that enables use of various fluids or fluid combinations. It would also be useful to provide a wipe dispensing system that enables relatively long-term storage of the substrate and fluids without material degradation of either.

More generally, on-demand dosing of substrates affords the user flexibility in terms of the time of use (i.e., they user may does immediately prior to use), variety of fluids and substrates, combination of fluids and substrates characteristics for specific applications, personalization of the fluid/substrate combination (i.e., one professional may prefer a first dose while another may prefer a second, different dose from the first one), cost reduction (e.g., the combination of substrate and fluid does not need to take place at the factory), etc.

The present disclosure provides devices and methods to address the above discussed problems and solutions. The present disclosure describes a device that can selectively wet a substrate on demand based on a preference of the user. More particularly, the disclosed substrate dispenser can allow different users to customize how the substrate is dosed and the same substrate dispenser can apply different fluids and/or fluid patterns and/or fluid amounts on the same substrates for different users. On-demand dosing of substrates may also help ensure the used fluids remain at full potency indefinitely or at least for prolonged periods of time as compared to, for example, pre-dosed wet wipes. On-demand dosing of substrates may also help ensure the used fluids do not heavily prematurely interact with the substrate, thereby preserving the efficacy of the substrate and the fluid.

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale According to an aspect of the disclosure, a fluid dosing substrate dispenser comprises a housing including a base portion, a first fluid reservoir and/or a first fluid reservoir holder configured to removably receive the first fluid reservoir, and a second fluid reservoir and/or a second fluid reservoir holder configured to removably receive the second fluid reservoir; a substrate advancing mechanism configured to receive substrate from a substrate source and to advance a portion of the substrate through the housing; an application mechanism configured to apply fluid from at least one of the first fluid reservoir or the second fluid reservoir to one or more portions of the substrate; and a computing system configured to control the application mechanism to apply the fluid and to select at least one of amount of fluid for application, composition of fluid for application, or portion of the substrate the fluid is applied based on an input received by the computing system, wherein the computing system is further configured to control the substrate advancing mechanism to advance the portion of the substrate through the housing based on the input received indicating a user of the substrate dispenser.

According to an embodiment of any paragraph(s) of this summary, the computing system includes a first profile and a second profile, wherein the first profile includes a first predetermined composition of fluid for application, wherein the second profile includes a second predetermined composition of fluid for application, wherein the computing system is further configured to select the first profile or the second profile based on the input received.

According to an embodiment of any paragraph(s) of this summary, the input received by the computing system comprises a wireless signal from a transmitter.

According to an embodiment of any paragraph(s) of this summary, the substrate dispenser further includes a proximity sensor configured to detect distance of the transmitter to the housing, wherein the computing system is further configured to control the application to apply the fluid when the transmitter is within a threshold distance from the housing.

According to an embodiment of any paragraph(s) of this summary, the first fluid reservoir holder includes a sensor configured to detect fluid content of the first fluid reservoir, wherein the second fluid reservoir holder includes a second sensor configured to detect fluid content of the second fluid reservoir.

According to an embodiment of any paragraph(s) of this summary, fluid in the first fluid reservoir and fluid in the second fluid reservoir are different.

According to an embodiment of any paragraph(s) of this summary, the housing further includes a third fluid reservoir holder configured to removably receive a third fluid reservoir, wherein the application mechanism is further configured to apply fluid from the third fluid reservoir.

According to an embodiment of any paragraph(s) of this summary, the computing system is configured to cause the application mechanism to apply fluid from the first fluid reservoir to a first portion of the substrate and to apply fluid from the second fluid reservoir to the first portion of the substrate on top of the fluid from the first fluid reservoir.

According to an embodiment of any paragraph(s) of this summary, the application mechanism comprises a plurality of nozzles arranged in a dot matrix.

According to an embodiment of any paragraph(s) of this summary, the portion of the substrate the fluid is applied to is a predetermined pattern.

According to an embodiment of any paragraph(s) of this summary, the application mechanism includes a fluid conduit to fluidly connect a nozzle to apply fluid to the substrate to the first fluid reservoir and the second fluid reservoir.

According to an embodiment of any paragraph(s) of this summary, the computing system is further configured to cause a second application mechanism to apply a cleaning fluid to the fluid conduit to flush the fluid conduit after applying the fluid to the substrate.

According to an embodiment of any paragraph(s) of this summary, further including a cutting mechanism configured to separate the substrate from a second substrate from the substrate source.

According to an embodiment of any paragraph(s) of this summary, the housing further includes a portion configured to removably retain the substrate source to allow substrate from the substrate source to be advanced by the substrate advancing mechanism.

According to another aspect of the disclosure, a computing system for operating a fluid dosing substrate dispenser comprises a processor; and memory that stores computer-executable instructions that, when executed by the processor, cause the processor to perform acts comprising: detecting presence of a user based on input received from a sensor of the substrate dispenser; advancing substrate from a substrate source through a housing via a substrate advancing mechanism in response to receiving the input; selecting at least one amount of fluid for application onto the substrate, composition of fluid for application onto the substrate, or portion of the substrate the fluid is applied based on the input received; and applying fluid from at least one a first fluid reservoir or a second fluid reservoir onto the advanced substrate via an application mechanism based on the selection.

According to an embodiment of any paragraph(s) of this summary, selecting includes selecting a profile from a list of profiles, wherein each profile corresponds to a different user.

According to an embodiment of any paragraph(s) of this summary, detecting presence of the user includes detecting a distance of the user from the housing.

According to an embodiment of any paragraph(s) of this summary, the acts further comprising separating the advanced substrate from a second substrate from the substrate source via a substrate separator.

According to yet another aspect of the disclosure, a method of operating a fluid dosing substrate dispenser comprises detecting presence of a user based on input received from a sensor of the substrate dispenser; advancing substrate from a substrate source through a housing via a substrate advancing mechanism in response to receiving the input; selecting at least one amount of fluid for application onto the substrate, composition of fluid for application onto the substrate, or portion of the substrate the fluid is applied based on the input received; and applying fluid from at least one a first fluid reservoir or a second fluid reservoir onto the advanced substrate via an application mechanism based on the selection.

According to an embodiment of any paragraph(s) of this summary, selecting includes selecting a profile from a list of profiles, wherein each profile corresponds to a different user.

To the accomplishment of the foregoing and related ends, the disclosure comprises the features hereinafter fully described and particularly pointed out in the claims. The following description and the annexed drawings set forth in detail certain illustrative embodiments of the disclosure. These embodiments are indicative, however, of but a few of the various ways in which the principles of the disclosure may be employed. Other objects, advantages and novel features of the disclosure will become apparent from the following detailed description when considered in conjunction with the drawings.

BRIEF DESCRIPTION OF DRAWINGS

The annexed drawings, which are not necessarily to scale, show various aspects of the disclosure.

DETAILED DESCRIPTION

Figure 1:
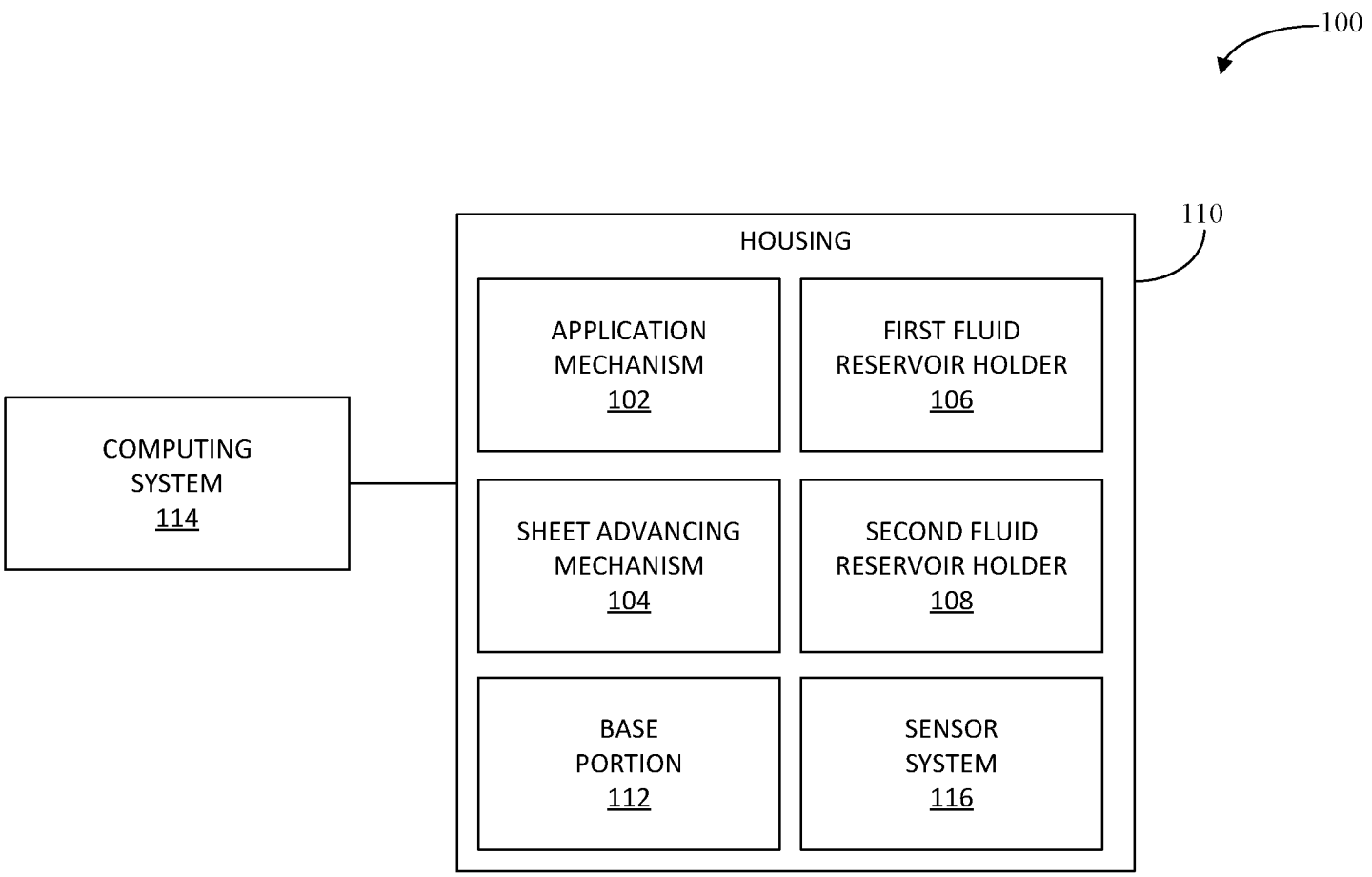
FIG. 1 is a functional block diagram of a fluid dosing substrate dispenser according to an embodiment of the disclosure.

Aspects of the present application that pertain to a fluid dosing substrate dispenser are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspect(s) may be practiced without these specific details.

In reference to the disclosure herein, for purposes of convenience and clarity only, directional terms, such as, top, bottom, left, right, up, down, upper, lower, over, above, below, beneath, rear, and front, may be used. Such directional terms should not be construed to limit the scope of the features described herein in any manner. It is to be understood that embodiments presented herein are by way of example and not by way of limitation. The intent of the following detailed description, although discussing exemplary embodiments, is to be construed to cover all modifications, alternatives, and equivalents of the embodiments as may fall within the spirit and scope of the features described herein.

Further, as used herein, the terms "component" and "system" are intended to encompass computer-readable data storage that is configured with computer-executable instructions that cause certain functionality to be performed when executed by a processor. The computer-executable instructions may include a routine, a function, or the like. It is also to be understood that a component or system may be localized on a single device or distributed across several devices. Further, as used herein, the term "exemplary" is intended to mean serving as an illustration or example of something and is not intended to indicate a preference.

FIG. 1 illustrates a functional block diagram of an example substrate dispenser 100 configured to provide a selectively dosed substrate. The substrate dispenser 100 may include an application mechanism 102, a substrate advancing mechanism 104, and/or at least one fluid reservoir or fluid reservoir holder. In the embodiments illustrated herein, the fluid reservoir holder is configured for insertion of a separate fluid reservoir, however it is conceivable that the fluid reservoir is embedded within the fluid reservoir holder and the user refills the embedded fluid reservoir instead of inserting the fluid reservoir. The application mechanism 102 may be configured to selectively apply one or more fluids onto the substrate. As will be described in detail below, any suitable fluid can be applied to suitable portions of the substrate and the fluid may include a composition of different fluids. The substrate advancing mechanism 104 may be configured to advance the substrate as the fluid is applied by the application mechanism 102.

The substrate dispenser 100 can include any suitable number of fluid reservoir holders, such as one fluid reservoir holder and/or a plurality of reservoir holders (e.g., three reservoir holders, five reservoir holders, or N number of reservoir holders). In the illustrated embodiment, the substrate dispenser 100 includes a first fluid reservoir holder 106 and a second fluid reservoir holder 108. Both the first fluid reservoir holder 106 and the second fluid reservoir holder 108 can be connected to the same application mechanism 104 and/or different application mechanisms can be used for different reservoir holders.

In the illustrated embodiment, the application mechanism 102, the substrate advancing mechanism 104, the first fluid reservoir holder 106, and the second fluid reservoir holder 108 are all contained within a housing 110. However, it is conceivable that the application mechanism 102, the substrate advancing mechanism 104, the first fluid reservoir holder 106, and/or the second fluid reservoir holder 108 (or portions thereof) may be located outside the housing 110 (and optionally may be attached to the housing 110). The housing 110 may include a base portion 112 configured to support the housing 110 on a surface. For instance, the base portion 112 can be configured to support the housing 110 on a horizontal surface, such as a counter or a bathroom vanity.

In another example, the base portion 112 can be configured for attachment to a vertical surface.

To control operation of the substrate dispenser 100, the substrate dispenser 100 can further include a computing system 114. As will be described in detail below, the computing system 114 can be configured to receive an input from a user of the substrate dispenser 100 and control the application mechanism 102 and/or the substrate advancing mechanism 104 in response to the input. The computing system 114 can be further configured to communicate with a sensor system 116 within the housing 110 to receive sensor inputs from the sensor system 116 to control the application mechanism 102 and/or the substrate advancing mechanism 104. As will be discussed in detail below, the sensor system 116 of the substrate dispenser 100 can include any suitable number of sensors that can be configured to detect a state of any suitable number of components in the substrate dispenser 100, such as substrate sensor, a fluid sensor, and/or the like.

The substrate dispenser 100 may yet further include a cutting mechanism configured to separate a dispensed substrate from an attached subsequent substrate. For instance, the cutting mechanism may include a sensor in the sensor system 116 that detects a perforation between the dispensed substrate and the subsequent substrate, and a separation operation is performed to separate the substrates. Any suitable separation operation can be used, such as slicing along the perforation, delivering pressurized air to the perforation to tear the perforation, and/or the like.

Figure 2:
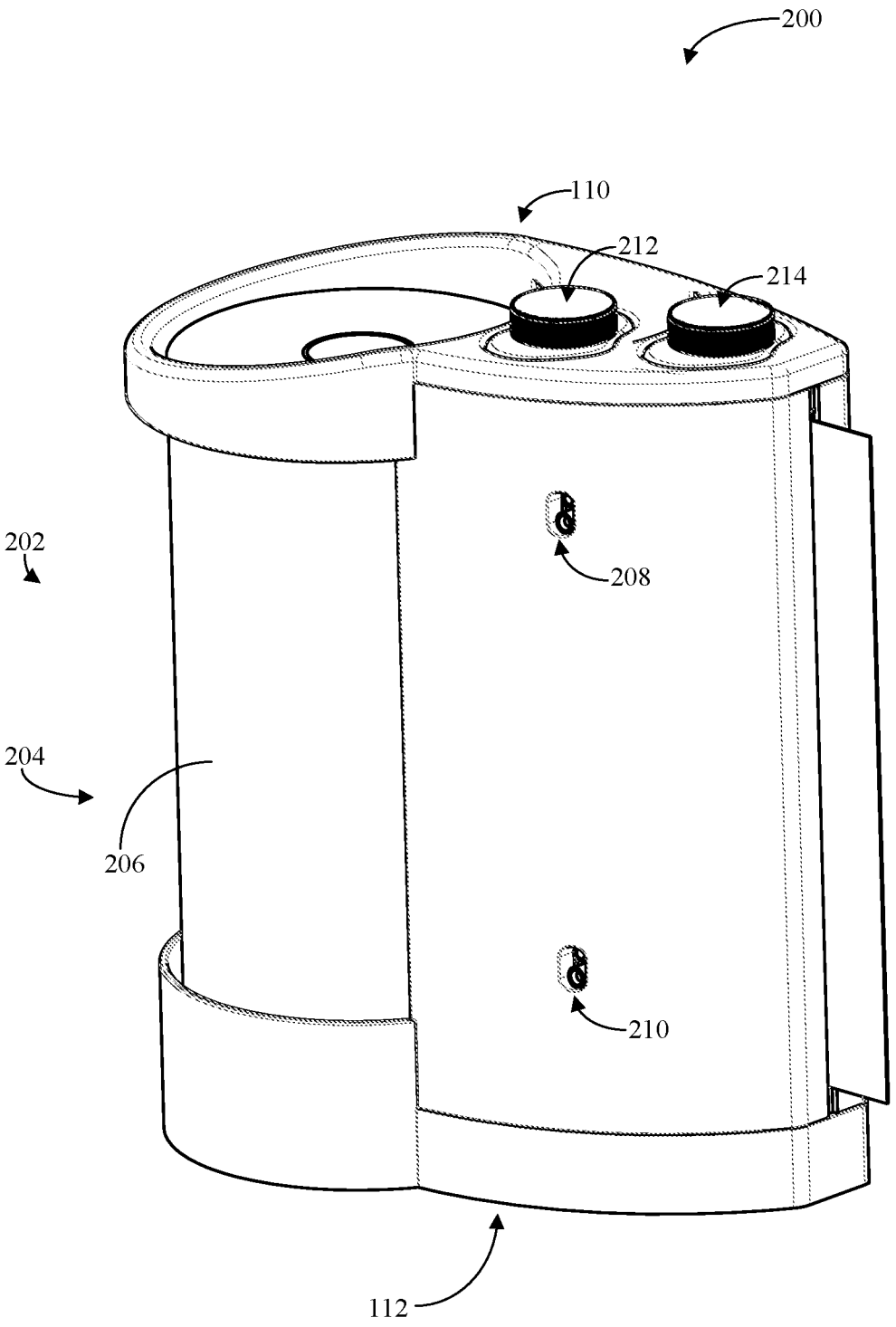
FIG. 2 is a perspective view of a fluid dosing substrate dispenser according to another embodiment of the disclosure.

Turning now to FIG. 2, illustrated is an exemplary implementation 200 of the substrate dispenser 100. In the illustrated embodiment, the substrate dispenser 200 includes the housing 110 that further includes a substrate source holder 202 configured to receive one or more substrate sources. The substrate source holder 202 can take any suitable shape, size, and/or configuration, and different configurations can be used for different substrate sources. In the illustrated embodiment, the substrate source holder 202 is configured as a cylindrical cavity 204 corresponding to a diameter of a standard commercial or domestic paper towel roll (e.g., Bounty®). In the illustrated embodiment, the substrate source holder 202 can be configured to support the paper towel roll 206 vertically. In another embodiment, the substrate source holder 202 can be configured to support the paper towel roll 206 horizontally or in other orientations.

The substrate source holder 202 can be further configured to inform the user of status of the substrate source (e.g., the paper towel roll 206) in the substrate source holder 202. For instance, the substrate source holder 202 can be configured to inform the user of number of substrates remaining in the substrate source. In the illustrated embodiment, the substrate source holder 202 is shaped to leave a portion of the paper towel roll 206 visible when the paper towel roll 206 is inserted into the substrate source holder 202. The substrate source holder 202 can leave any portion of the paper towel roll 206 visible, such as more than fifty percent as illustrated.

The sensor system 116 of the substrate dispenser 100 can further include one or more sensors for detecting intent of the user. For instance, the illustrated substrate dispenser 200 includes a first sensor 208 and a second sensor 210 (hereafter, sensors 208, 210) that can detect the user's hand proximate the sensors 208, 210. The computing system 114 can be configured to use this detection by the sensors 208, 210 to predict the user's intent to advance the substrate from the paper towel roll 206. The sensors 208, 210 can be further configured to indicate different intents. More particularly, detecting the user's hand proximate the first sensor 208 may cause the substrate dispenser 200 to dispense a dry substrate, while detecting the user's hand proximate the second sensor 210 may cause the substrate dispenser 200 to dispense a wet substrate.

To prevent the substrate dispenser 200 from inadvertently dispensing substrate, the sensors 208, 210 can be configured to detect distance of the user from the housing 110. For instance, the sensor 208 can determine the distance between the user and the housing 110 based on the user's hand from the housing. The sensors 208, 210 can be further configured to provide the input to the computing system 114 when the user's hand is within a threshold distance from the housing 110.

The housing 110 of the substrate dispenser 200 can be configured hold one or more fluid reservoirs. In the illustrated embodiment, the housing 110 includes both the first fluid reservoir holder 106 and the second fluid reservoir holder 108 to hold a multitude of fluid reservoirs. The illustrated fluid reservoir holders 106, 108 are configured to hold corresponding fluid reservoirs vertically, but can be configured to hold the fluid reservoirs at any suitable angle, such as horizontally. The first fluid reservoir holder 106 and the second fluid reservoir holder 108 (and their corresponding fluid reservoirs) can be similarly shaper and/or can vary. In the illustrated embodiment, a first fluid reservoir 212 and a second fluid reservoir 214 (hereafter fluid reservoirs 212, 214) are similarly shaped.

Figure 3:
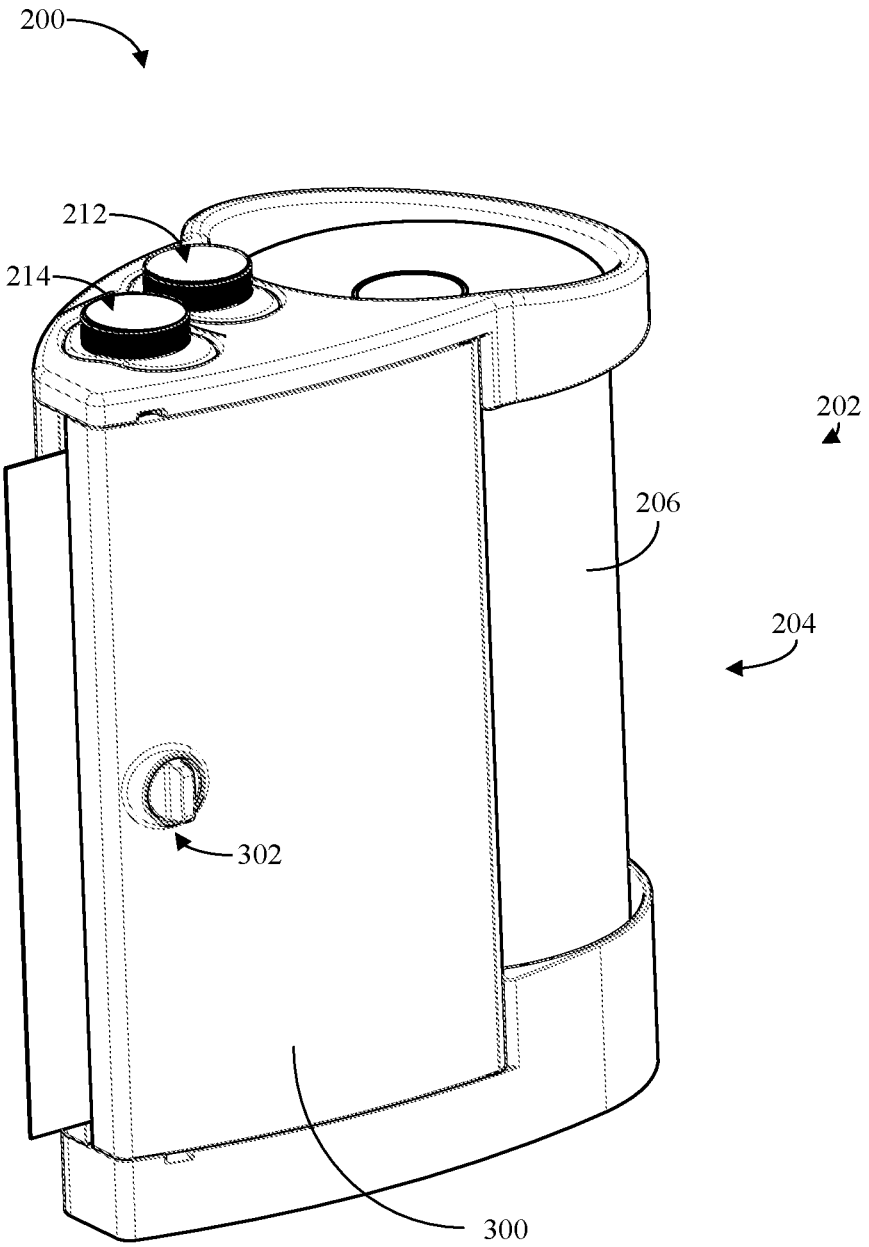
FIG. 3 is another view of the exemplary fluid dosing substrate dispenser of FIG. 2.

As seen more clearly in FIG. 3, the housing 110 of the substrate dispenser 200 may further include a cover or door 300 that permits the user to access one or more interior portions of the housing 110. The door 300 may further include a latch 302 to allow the user to selectively open or secure the door 300 as desired.

As briefly noted above, the computing system 114 can be configured to control one or more components of the substrate dispenser 100 to dispense selectively dampened substrates. The substrate dispenser 100 can be configured for personalization such that the computing system 114 can select which fluid(s) (if any) is applied to which portion(s) of the substrate based on the user of the substrate dispenser 100. For instance, a first fluid can be applied to a first portion of a substrate for a first user and the first fluid can be applied to a different second portion of a substrate for a second user.

Figure 4:
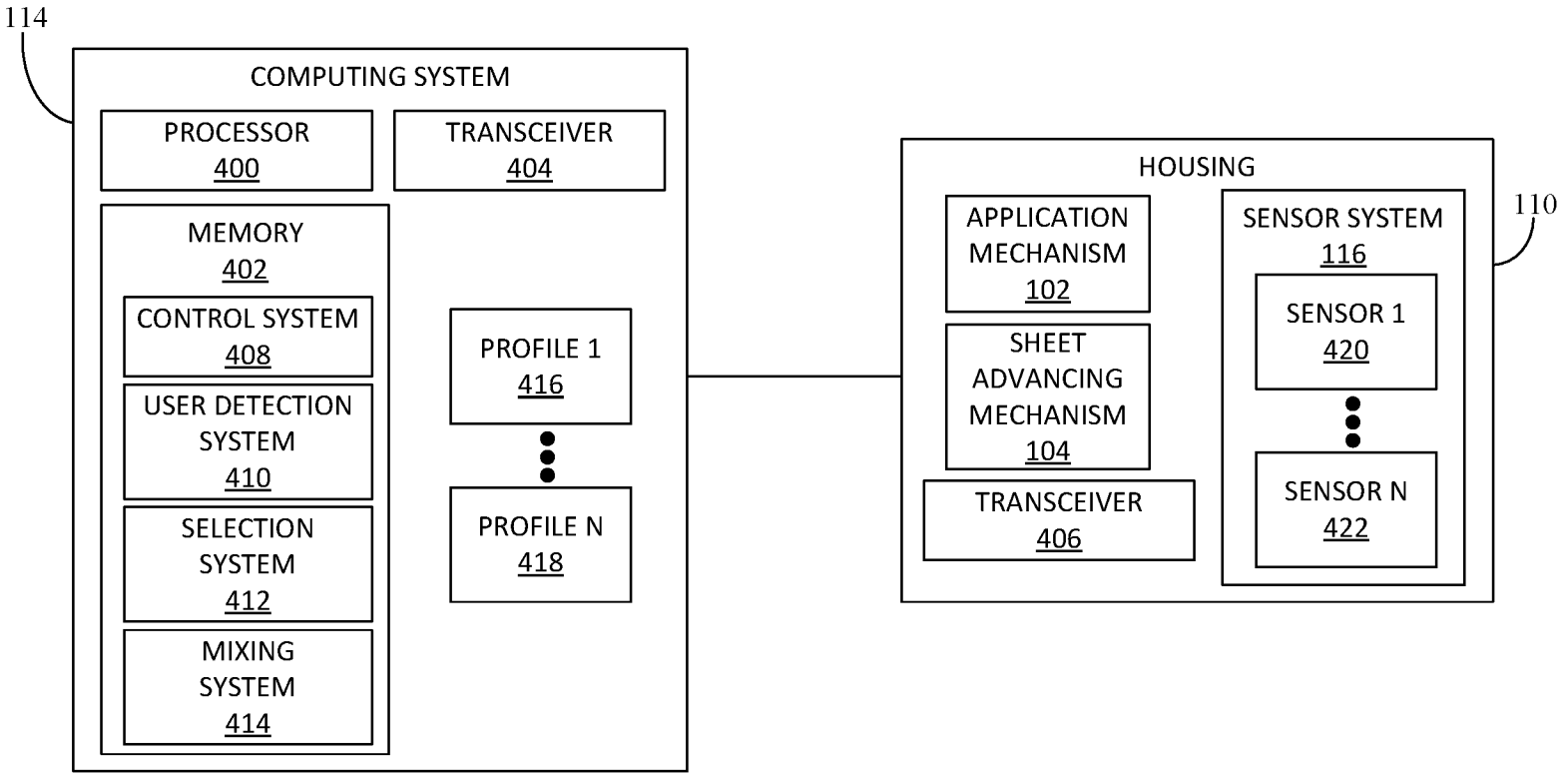
FIG. 4 is a functional block diagram of exemplary computing system of a fluid dosing substrate dispenser according to an embodiment of the disclosure.

The computing system 114 can include any suitable components for the personalization and illustrated in FIG. 4 is an example computing system 114. The computing system 114 is in communication with one or more components of the substrate dispenser 100 such as the application mechanism 102, the substrate advancing mechanism 104, and/or the sensor system 116. The computing system 114 includes a processor 400 and memory 402 that includes computer-executable instructions that are executed by the processor 400. In an example, the processor 400 can be or include a graphics processing unit (GPU), a plurality of GPUs, a central processing unit (CPU), a plurality of CPUs, an application-specific integrated circuit (ASIC), a microcontroller, or the like To receive information from the components in the housing 110 and to transmit information to the components, the computing system 114 may further include a transceiver 404. The transceiver 404 can be configured to transmit data from the computing system 114 and/or receive data at the computing system 114. The housing 110 can further include a corresponding transceiver 406 to transmit data from the housing 110 and/or receive data at the housing 110.

The memory 402 includes a control system 408 configured to control operation of the application mechanism 102, the substrate advancing mechanism 104, and/or the sensor system 116. The control system 408 can be configured to control which fluid (if any) is applied to which part(s) of a substrate based on a predefined preference of the user operating the substrate dispenser 100. The control system 408 can be further configured to receive sensor input from the sensor system 116 to operate the substrate advancing mechanism 104 based on the sensor system 116 detecting the presence of the substrate. The control system 408 can yet further operate the application mechanism 102 based on sensor input from the sensor system 116 detecting that applied fluid on the substrate resulted in a catalyzing reaction.

The memory 402 can further include a user detection system 410 configured to determine which user is operating the substrate dispenser 100. The computing system 114 can use this information to determine which fluids (if any) should be applied and what portion(s) of the substrate to apply the fluids. In one example, the user detection system 410 is configured to receive data (via the transceiver 404) from a mobile transmitter operated by the user, such as a cellphone. The data can indicate personal identification associated with the user, such as name, personal identification number, and/or the like. In another example, the user detection system 410 is configured to receive data (via the transceiver 404) from a wireless transmitter, such as a key fob, associated with the user.

The memory 402 further includes a selection system 412 that, responsive to receiving data indicating identification of the user, selects a profile associated with the user. The profile can include any suitable information provided by the user to the computing system 114, such as fluid selection, application pattern, fluid sensitivity, substrate type, and/or the like. In the illustrated embodiment, the computing system 114 includes a plurality of profiles, namely, a profile 1 416, . . . , and a profile N 418 (collectively referred to herein as profiles 416 and 418). Each of the profiles 416 and 418 can be associated with a different user and/or a user may have multiple profiles. For instance, profile 1 416 can be associated with a first user while profile N 418 can be associated with a different second user. In another example, both profile 1 416 and profile N 418 are associated with the same user but pertain to different scenarios. For instance, profile 1 416 can include a first fluid selection, while profile N 418 can include a different second fluid selection. In another instance, profile 1 416 can include a first application pattern, while profile N 418 can include a different second application pattern.

The memory 402 can yet further include a mixing system 414 configured to control the operation of the application mechanism 102 to mix fluids from the first fluid reservoir holder 106 and the second fluid reservoir holder 108 before application onto a substrate. The mixing system 414 can yet further control the substrate advancing mechanism 104 to advance a substrate for application by the application mechanism 102 after a threshold mixture of fluids is achieved.

As briefly mentioned above, the sensor system 116 can include any suitable number of sensors to provide sensor input to the memory 402 for use by the computing system 114, application mechanism 102, and/or substrate advancing mechanism 104. In the embodiment illustrated in FIG. 4, the sensor system 116 includes sensor 1 420, . . . , and a sensor N 422 (collectively referred to herein as sensors 420 and 422). Each of the sensors 420 and 422 can be configured to detect a state of a different component or multiple sensors may be configured to detect different states of the same component. For instance, sensor 1 420 can be configured to detect a location of a leading edge of a substrate in the housing while sensor N 422 can be configured to detect the perforation between the dispensed substrate and the subsequent substrate. One or more of the sensors 420 and 422 can be configured to detect an amount of fluid in each fluid reservoir inserted into the housing 110 and the control system 408 can be configured to use the detected fluid amount to inform a user when a detected fluid amount is below a predetermined threshold.

Thus, one or more users can create different profiles that indicate a personalized substrate that is dispensed by the substrate dispenser 100. For example, a first user can indicate in their profile a sensitivity to certain cleaning products and the control system 408 can cause the application mechanism 102 to apply less (or none) of the cleaning product onto the substrate compared to other applications for other users. Moreover, different fluid patterns can be applied to different substrates based on a selected profile.

Figure 5:
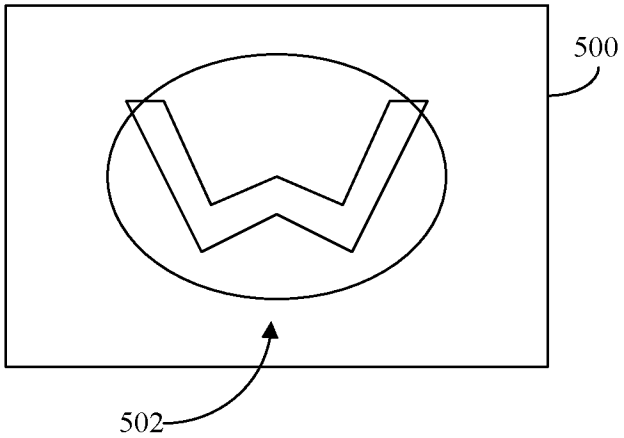
FIG. 5 is a view of dosed substrate from a fluid dosing substrate dispenser according to an embodiment of the disclosure.

For instance, illustrated in FIG. 5 is a fluid pattern 502 applied on a substrate 500. The control system 408 can be configured to operate the application mechanism 102 such that fluid is selectively applied to the substrate 500 such that substrate 500 includes the pattern 502 when the substrate 500 is dispensed by the substrate dispenser 100. In one example, the fluid is absorbed by the substrate 500 and the control system 408 is further configured to operate the application mechanism 102 such that the substrate 500 after absorbing the fluid forms the fluid pattern 502.

Figure 6:
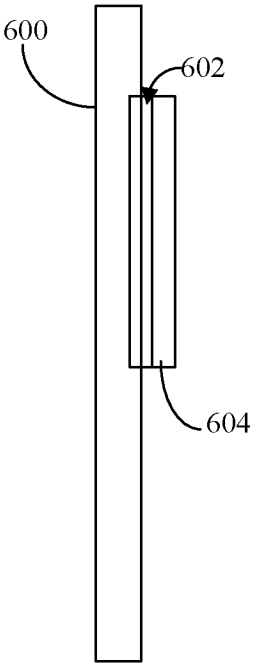
FIG. 6 is a view of a dosed substrate from a fluid dosing substrate dispenser according to another embodiment of the disclosure.

By controlling both the application mechanism 102 and the substrate advancing mechanism 104, the control system 408 can be further configured to layer fluids on top of one another. For instance, interaction between a first fluid and a second fluid can cause a catalyzing reaction in the first fluid. However, the catalyzing reaction may last for a short duration, so the first fluid and the second fluid cannot be pre-combined and applied to substrates in conventional dispensing packages. Thus, it is preferable to combine the fluids right before dispensing a coated substrate. In an exemplary embodiment, the control system 408 can be configured to operate the application mechanism 102 such that a first fluid (e.g., from the first fluid reservoir 212) is applied to a first portion of the substrate and the second fluid (e.g., from the second fluid reservoir 214) is then applied to the same first portion to trigger the catalyzing reaction. An example of this application can be seen in FIG. 6, where a first fluid 602 is applied on a portion of a substrate 600, which has begun absorbing the first fluid 602. A second fluid 604 is then applied to the same portion of the substrate 600 to start the catalyzing reaction with the first fluid 602. To prevent the catalyzing reaction expiring before the substrate 600 is dispensed, the control system 408 can be configured to cause the application mechanism 102 to apply the first fluid 602 and/or the second fluid 604 only after the sensor system 116 (e.g., sensors 208, 210) detect a request for the dampened substrate 600 from the user.

Figure 7:
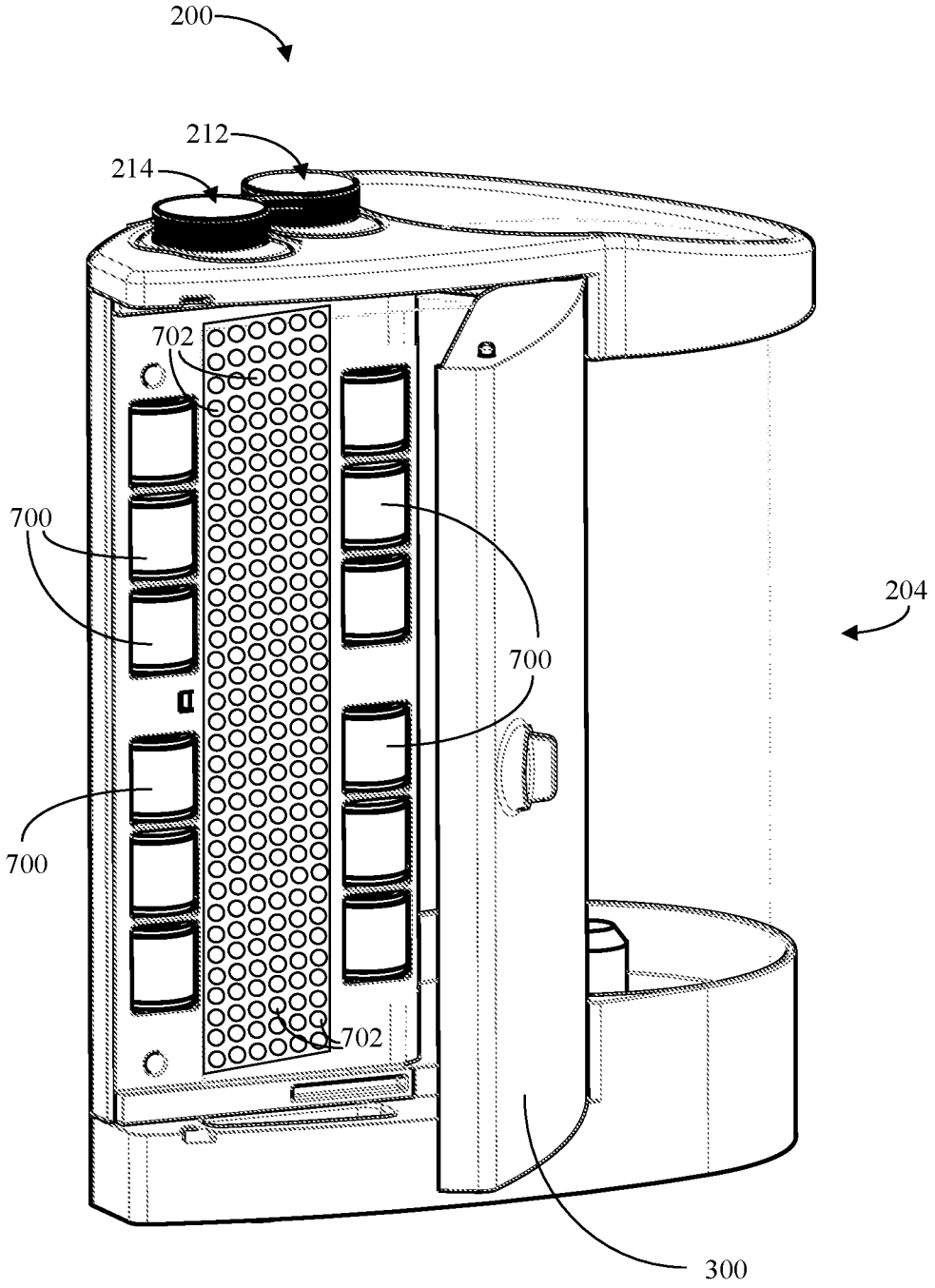
FIG. 7 is a view of the fluid dosing substrate dispenser of FIG. 2 with its door open according to an embodiment of the disclosure.

The application mechanism 102 and/or the substrate advancing mechanism 104 can take any suitable shape, size, and/or configuration, and different configurations may be used for different housings 110, substrates, fluid reservoirs (e.g., the first fluid reservoir 212), and/or the like. Illustrated in FIG. 7 is an example substrate advancing mechanism 104 that includes a plurality of drive rollers 700. In response to the computing system 114 receiving data indicating a request for a substrate, the control system 408 can drive the rollers 700 to advance a substrate in contact with the rollers 700. The roller 700 can operate at any suitable speed and may operate continuously and/or intermittently. For instance, the rollers 700 may operate to advance a substrate to the application mechanism 102, then stop rolling to permit the application mechanism 102 to apply the fluid to the substrate, then resume operation to advance the now coated substrate out of the substrate dispenser 200. The substrate advancing mechanism 104 can include any suitable number of rollers 700, and in the illustrated embodiment, the substrate advancing mechanism 104 includes sets of rollers 700 on each side of application mechanism 102, described in detail below.

In the illustrated embodiment, the application mechanism 102 includes a plurality of nozzles 702 arranged in a grid that extends vertically in the housing 200. Each of the nozzles 702 can be independently operated to cause a select fluid (e.g., from the first fluid reservoir 212 and/or the second fluid reservoir 214) to be applied to the substrate in front of the nozzles. By using a plurality of nozzles 702 arranged across a width of the substrate, the illustrated application mechanism 102 can generate different application patterns.

The cutting mechanism can also use the nozzles 702 to separate the dispensed substrate from a subsequent substrate. For instance, the cutting mechanism can detect that a perforation between the dispensed substrate and the subsequent substrate is aligned with the nozzles 702 and pressurized air is shot out of one or more nozzles 702 to tear the perforation.

Figure 8:
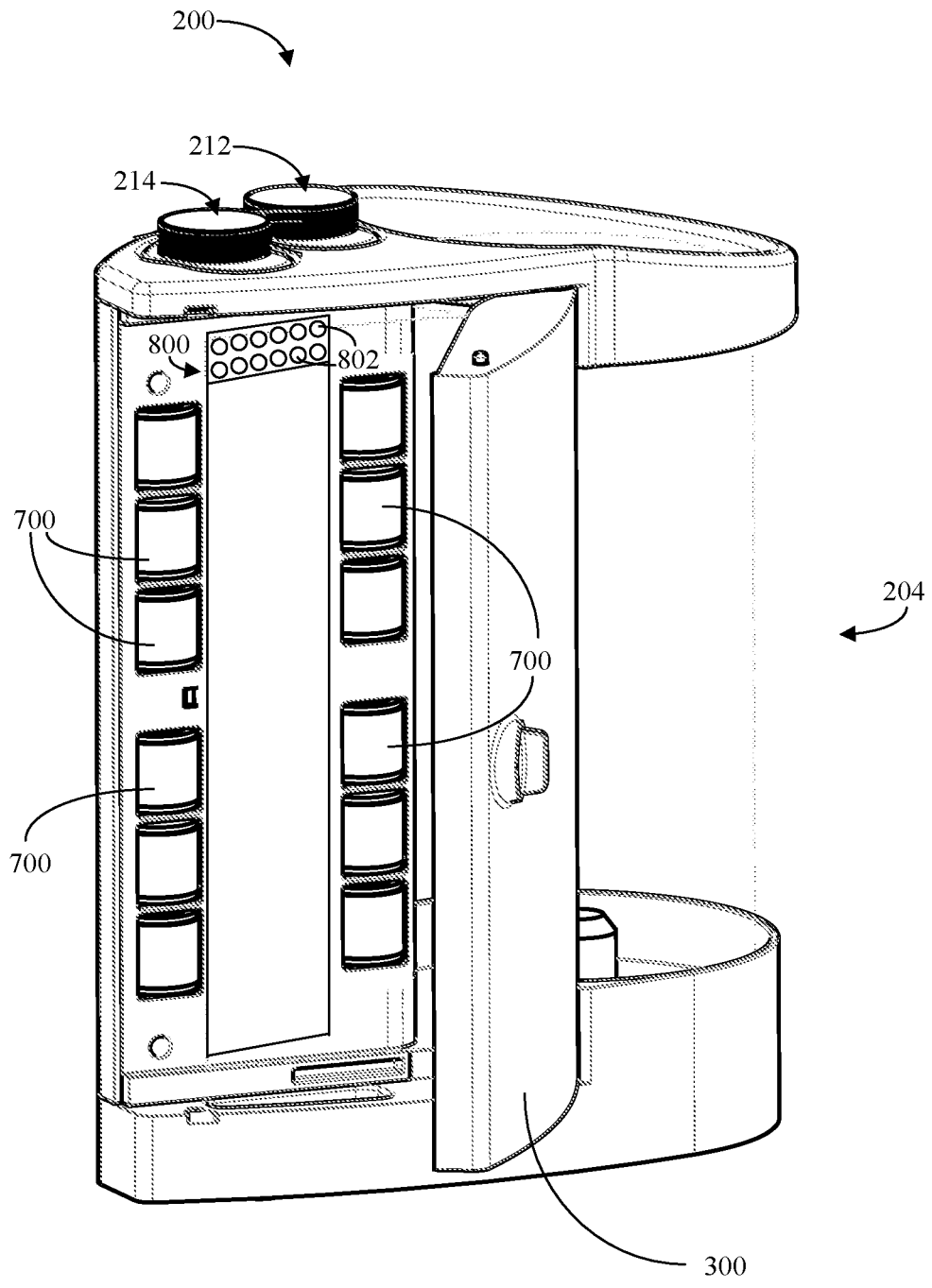
FIG. 8 is a view of the fluid dosing substrate dispenser of FIG. 2 with its door open according to another embodiment of the disclosure.
Figure 9:
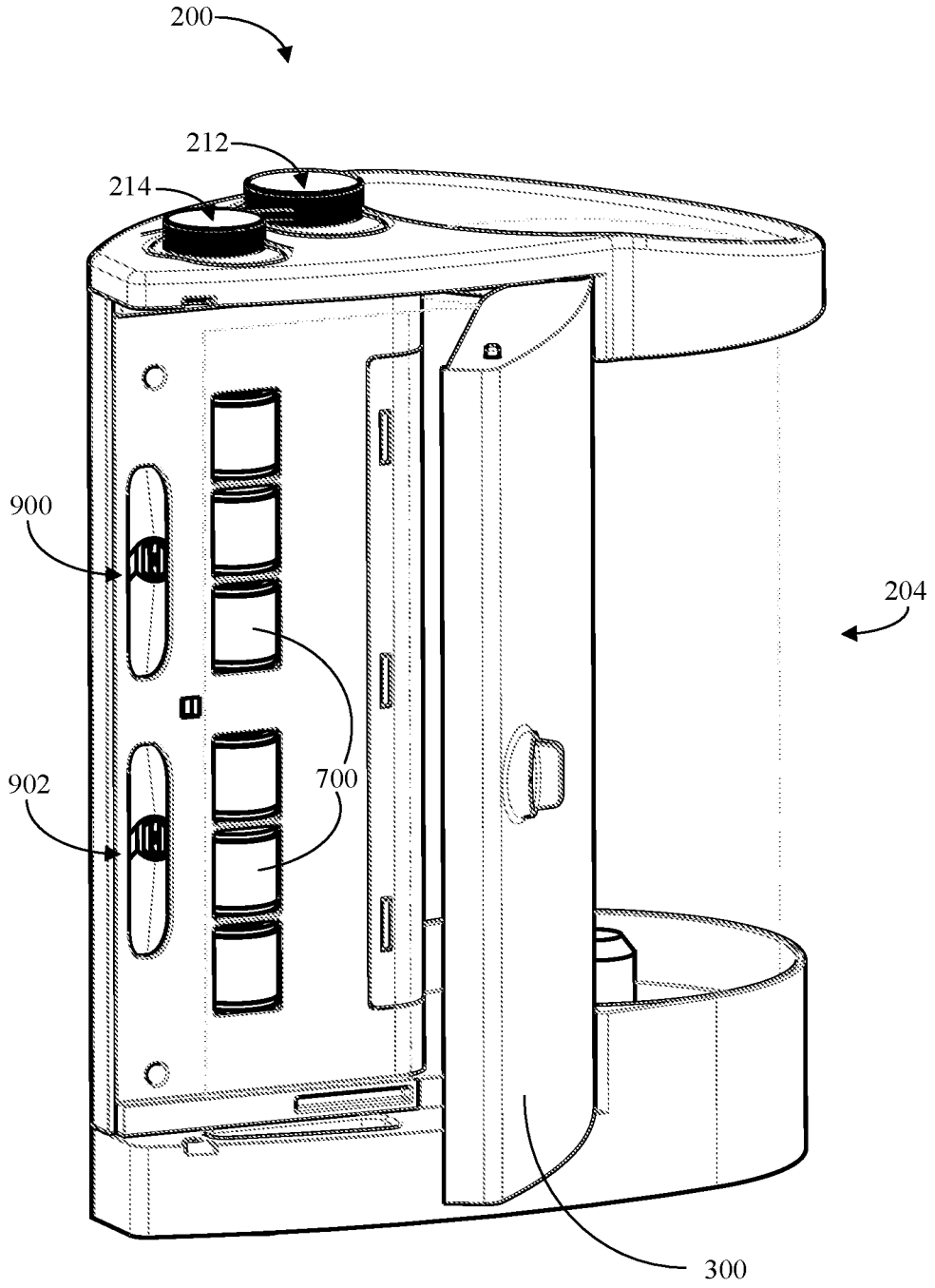
FIG. 9 is a view of a fluid dosing substrate dispenser of FIG. 2 with its door open according to a further embodiment of the disclosure FIGS. 10-12 illustrated a method for refilling the exemplary fluid dosing substrate dispenser with two fluid reservoirs according to an embodiment of the disclosure.

In another example, illustrated in FIG. 8, instead of using individual nozzles arranged in the grid, the application mechanism 102 includes a moving head 800 that includes fewer nozzles 802. Similar to a dot-matrix printer, the head 800 can be moved as needed to align the nozzles 802 with different portions of the substrate to be coated. In a further example, the application mechanism 102 can instead include two stationary nozzles 900 and 902 arranged vertically in the housing 110, as illustrated in FIG. 9.

Figure 10:
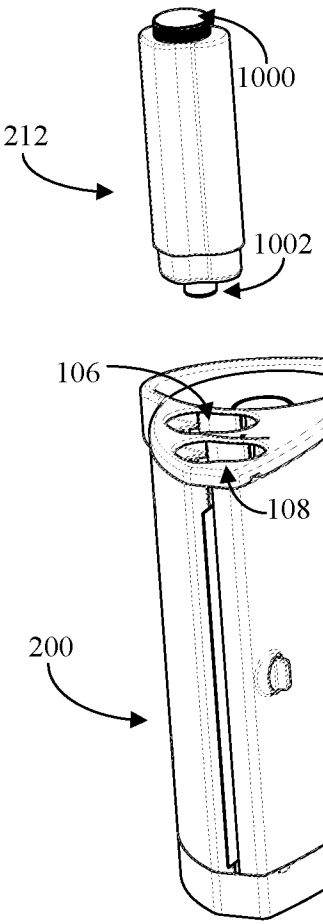
Figure 11:
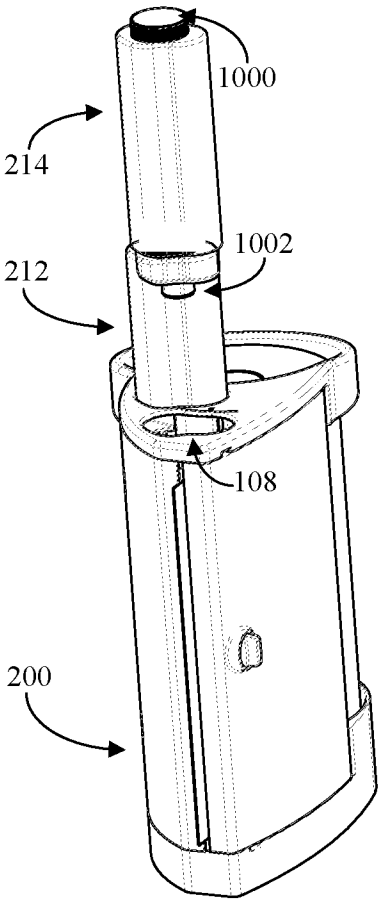
Figure 12:
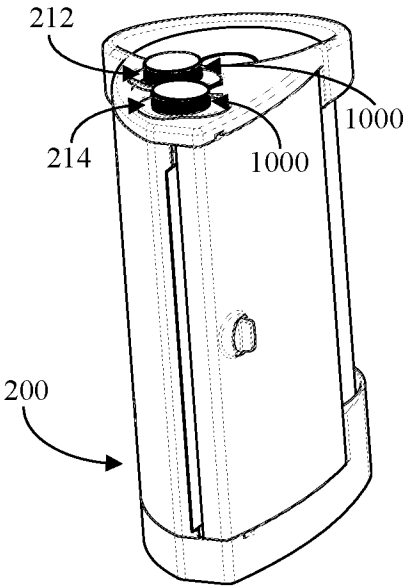

FIGS. 10-12 illustrate a method for refilling or replacing the first fluid reservoir 212 and/or the second fluid reservoir 214. In the illustrated method, the first fluid reservoir 212 is inserted before the second fluid reservoir 214 is inserted, but different methods can be used, such as simultaneous insertion. In a first step (FIG. 10), the first fluid reservoir 212 is lined up with the first fluid reservoir holder 106 formed on the housing 200. At step two (FIG. 11), the first fluid reservoir 212 is inserted into the first fluid reservoir holder 106 and the second fluid reservoir 214 is lined up with the second fluid reservoir holder 108. At step three (FIG. 12), both the first fluid reservoir 212 and the second fluid reservoir 214 are fully inserted into their corresponding fluid reservoir holders 106 and 108.

In the illustrated embodiment, both the first fluid reservoir 212 and the second fluid reservoir 214 have a similar shape but may vary as needed. The first fluid reservoir 212 and the second fluid reservoir 214 may resemble a bottle with a removable cap 1000 at one end that may be removed to refill the corresponding fluid reservoir with fluid. The other end of the first fluid reservoir 212 and the second fluid reservoir 214 may include a fluid interface 1002 that interacts with a fluid interface of the housing 110.

Figure 13:
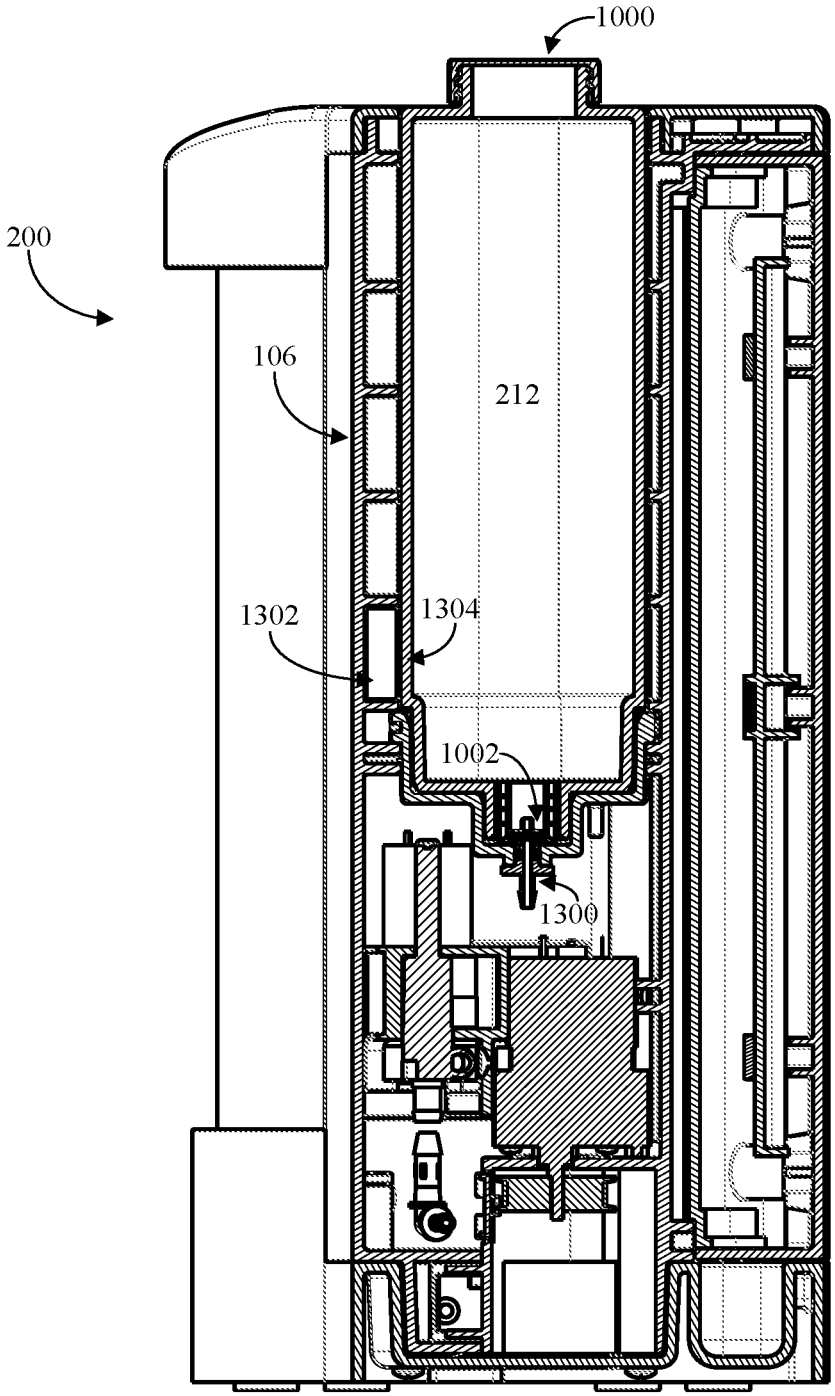
FIG. 13 is a cross-sectional view of the exemplary fluid dosing substrate dispenser in the assembled state according to an embodiment of the disclosure.

Turning now to FIG. 13, illustrated is a cross-sectional view of first fluid reservoir 212 fully inserted into the first fluid reservoir holder 106. The second fluid reservoir 214 and the corresponding second fluid reservoir holder 108 may be similar to the description herein or may vary. In one embodiment, the fluid interface 1002 of the first fluid reservoir 212 includes a self-resealing membrane valve. The application mechanism 102 may include a protruding nozzle 1300 configured to perforate the self-resealing membrane valve of the fluid interface 1002 of the first fluid reservoir 212 when it is inserted in the first fluid reservoir holder 106. The protruding nozzle 1300 perforating the self-resealing membrane valve interface 1002 effectively fluidly connects the first fluid reservoir 212 to the rest of the application mechanism 102. An advantage of the arrangement in which the protruding nozzle 1300 perforates the self-resealing membrane valve interface 1002 is that the first fluid reservoir 212 may be removed from the first fluid reservoir holder 106, even while fluid remains in the first fluid reservoir 212, without spilling fluid. The self-resealing membrane valve interface 1002 reseals the first fluid reservoir 212 upon removal from the nozzle 1300 to prevent spillage.

In an embodiment, the application mechanism 102 includes a fluid reservoir reader 1302 disposed in the first fluid reservoir holder 106 and the first fluid reservoir 212 includes an identification 1304 (e.g., QR code, RFID, etc.) such that, when the first fluid reservoir 212 is installed in the first fluid reservoir holder 106, the fluid reservoir reader 1302 may read the identification 1304 and, thereby, identify the first fluid reservoir 212 or a type of fluid in the first fluid reservoir 212. This information might be very useful. For example, the control system 408 may select or alter a volume of fluid dispensed per unit time or per substrate length based on the identification 1304 such that the portion of the substrate receives a first volume of fluid per unit time or per substrate length when a first type of fluid is in the first fluid reservoir 212 and a second volume of fluid per unit time or per substrate length, different from the first volume, when a second type of fluid, different from the first type of fluid, is in the first fluid reservoir 212. The identification may also be used to identify necessary labeling (e.g., chemical, FDA) or other characteristics of the fluid (e.g., viscosity) that may be used to inform the user or to operate the substrate dispenser 100 in certain ways based on the fluid. The identification 1304 may further be used by the control system 408 to determine which fluid(s) the user wants applied to the substrate when multiple fluid reservoirs are attached to the application mechanism 102.

In another example, the control system 408 may select or alter a rate at which the substrate advancing mechanism 104 advances substrate based on the identification 1304 to, for example, advance a first length of substrate per unit time when a first fluid type is in the first fluid reservoir 212 and a second length of substrate per unit time, different from the first length, when a second type of fluid, different from the first type of fluid, is in the first fluid reservoir 212.

The identification 1304 may further be used to verify that the first fluid reservoir 212, and thus the fluid therein, are legitimate and/or approved for use in the substrate dispenser 200.

In an embodiment, the application mechanism 102 may use a meter or equivalent (e.g., dry pump detect) to determine a volume of fluid used or remaining in the first fluid reservoir 212. Based on this information and/or stored information about the fluid or the first fluid reservoir 212 currently installed, the computing system 114 may determine that fluid has or is about to run out. Refill information may be communicated locally (e.g., local notification) or remotely (e.g., wired, wireless, or Internet signal transmission) to notify a user of the need to refill or replace the first fluid reservoir 212.

The application mechanism 102 may further include a fluid conduit, such as tubing, to fluidly connect the first fluid reservoir 212 and/or the second fluid reservoir 214 to the nozzles described above (e.g., nozzles 702). In one embodiment, shared tubing may connect the fluid reservoirs 212, 214 to the same nozzles. In another embodiment, different tubing is used to connect different nozzles to different fluid reservoirs 212, 214 to limit contamination of the tubing. The application mechanism 102 may be further configured to flush the tubing to prevent fluid build-up within the tubing and/or unintended mixing of fluids within the tubing. For instance, the application mechanism 102 may be configured to provide another fluid (e.g., pressurized air) into the tubing to flush out any remaining fluid from the fluid reservoirs 212, 214 that may remain in the tubing after dosing a substrate.

Figure 14:
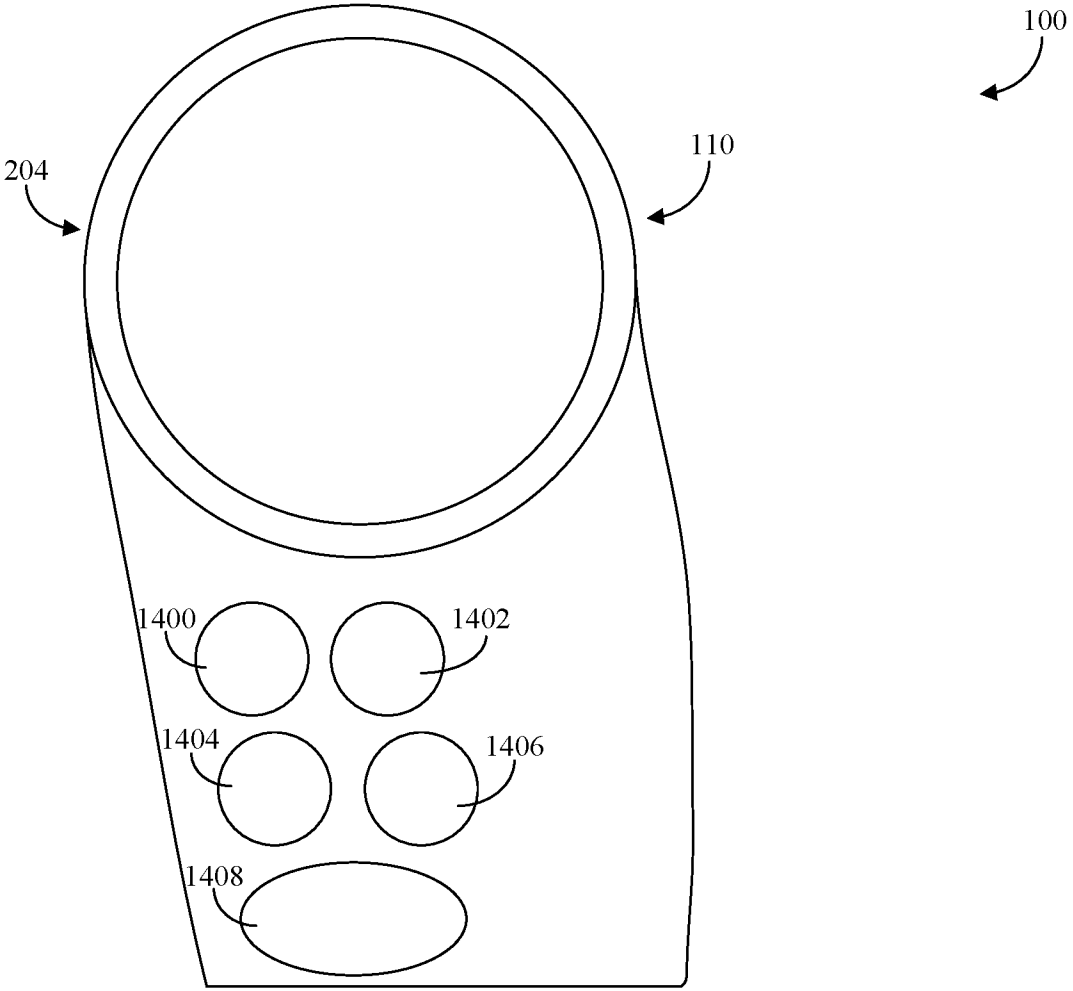
FIG. 14 is another perspective view of a fluid dosing substrate dispenser according to another embodiment of the disclosure.

As briefly mentioned above, the substrate dispenser 100 can include any suitable number of fluid reservoirs and/or fluid reservoir holders with any suitable shape and/or size. Illustrated in FIG. 14 is an embodiment of the substrate dispenser 100 with five fluid reservoir holders in the same housing 110. More particularly, the substrate dispenser 100 includes a first fluid reservoir holder 1400, a second fluid reservoir holder 1402, a third fluid reservoir holder 1404, and a fourth fluid reservoir holder 1406 that have a similar cross-sectional shape and a fifth fluid reservoir holder 1408 that has a different cross-sectional shape. In addition to the fluid holders described above that contain a single fluid, the substrate dispenser 100 can be shaped to use a fluid reservoir that includes two separate barrels to separate two components prior to application (e.g., a two-part epoxy syringe). For instance, the fifth fluid reservoir holder 1408 has a larger cross-sectional shape compared to the first fluid reservoir holder 1400 to receive the two-barrel fluid reservoir.

Figure 15:
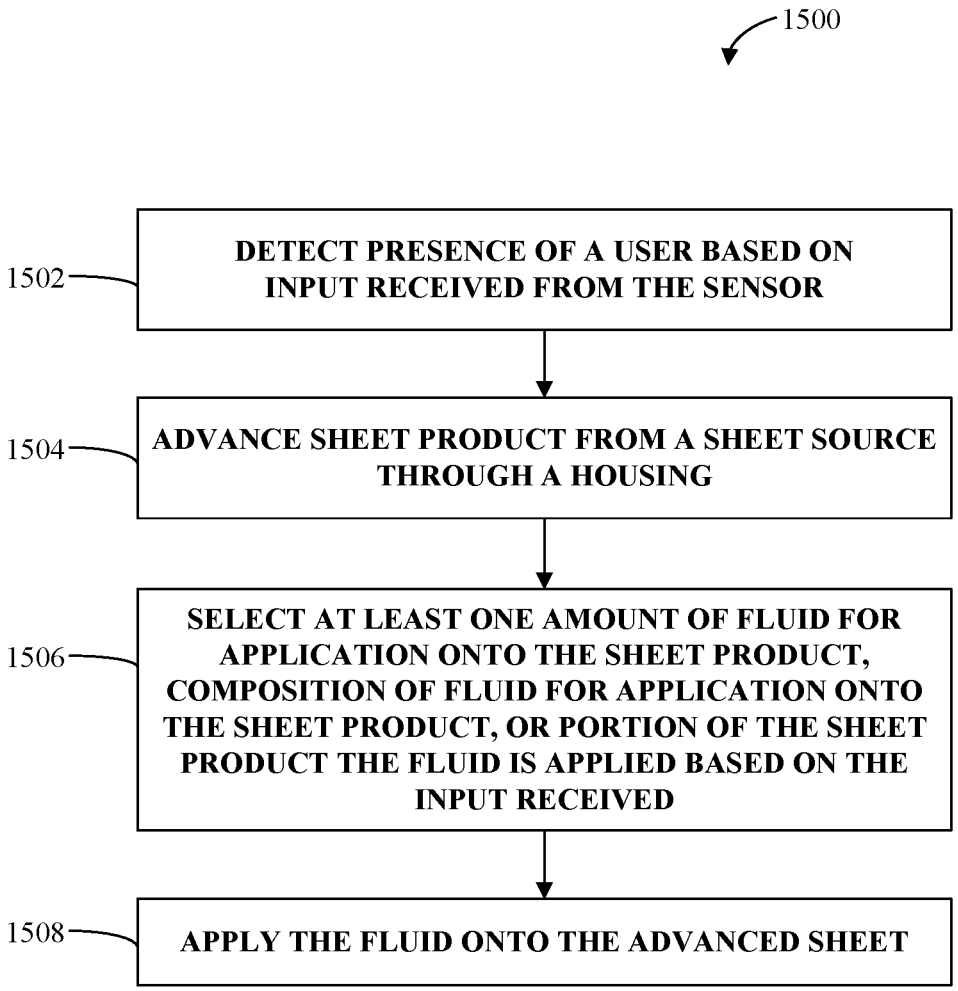
FIG. 15 is a high-level flow chart of a method according to an embodiment of the disclosure.

FIG. 15 shows a high-lever flow of a method 1500 of operating a substrate dispenser 100 (FIG. 1). In step 1502, presence of a user is detected based on input received from the sensor. In step 1504, substrate is advanced from a substrate source through a housing via a substrate advancing mechanism in response to receiving the input. In step 1506, at least one amount of fluid for application onto the substrate, composition of fluid for application onto the substrate, or portion of the substrate the fluid is applied based on the input received is selected. In step 1508, fluid is applied from at least one a first fluid reservoir or a second fluid reservoir onto the advanced substrate via an application mechanism based on the selection.

Definitions

The following includes definitions of selected terms employed herein. The definitions include various examples or forms of components that fall within the scope of a term and that may be used for implementation. The examples are not intended to be limiting. Both singular and plural forms of terms may be within the definitions.

An "operable connection," or a connection by which entities are "operably connected," is one in which signals, physical communications, or logical communications may be sent or received. Typically, an operable connection includes a physical interface, an electrical interface, or a data interface, but it is to be noted that an operable connection may include differing combinations of these or other types of connections sufficient to allow operable control. For example, two entities can be operably connected by being able to communicate signals to each other directly or through one or more intermediate entities like a processor, operating system, a logic, software, or other entity. Logical or physical communication channels can be used to create an operable connection.

Signal," as used herein, includes but is not limited to one or more electrical or optical signals, analog or digital signals, data, one or more computer or processor instructions, messages, a bit or bit stream, or other means that can be received, transmitted, or detected.

"Software," as used herein, includes but is not limited to, one or more computer or processor instructions that can be read, interpreted, compiled, or executed and that cause a computer, processor, or other electronic device to perform functions, actions or behave in a desired manner. The instructions may be embodied in various forms like routines, algorithms, modules, methods, threads, or programs including separate applications or code from dynamically or statically linked libraries. Software may also be implemented in a variety of executable or loadable forms including, but not limited to, a stand-alone program, a function call (local or remote), a servlet, an applet, instructions stored in a memory, part of an operating system or other types of executable instructions. It will be appreciated by one of ordinary skill in the art that the form of software may depend, for example, on requirements of a desired application, the environment in which it runs, or the desires of a designer/programmer or the like. It will also be appreciated that computer-readable or executable instructions can be located in one logic or distributed between two or more communicating, co-operating, or parallel processing logics and thus can be loaded or executed in serial, parallel, massively parallel, and other manners.

Suitable software for implementing the various components of the example systems and methods described herein may be produced using programming languages and tools like Java, Pascal, C#, C++, C, CGI, Perl, SQL, APIs, SDKs, assembly, firmware, microcode, or other languages and tools. Software, whether an entire system or a component of a system, may be embodied as an article of manufacture and maintained or provided as part of a computer-readable medium as defined previously. Another form of the software may include signals that transmit program code of the software to a recipient over a network or other communication medium. Thus, in one example, a computer-readable medium has a form of signals that represent the software/firmware as it is downloaded from a web server to a user. In another example, the computer-readable medium has a form of the software/firmware as it is maintained on the web server. Other forms may also be used.

"User" or "consumer," as used herein, includes but is not limited to one or more persons, software, computers or other devices, or combinations of these.

Some portions of the detailed descriptions that follow are presented in terms of algorithms and symbolic representations of operations on data bits within a memory. These algorithmic descriptions and representations are the means used by those skilled in the art to convey the substance of their work to others. An algorithm is here, and generally, conceived to be a sequence of operations that produce a result. The operations may include physical manipulations of physical quantities. Usually, though not necessarily, the physical quantities take the form of electrical or magnetic signals capable of being stored, transferred, combined, compared, and otherwise manipulated in a logic and the like.

It has proven convenient at times, principally for reasons of common usage, to refer to these signals as bits, values, elements, symbols, characters, terms, numbers, or the like. It should be borne in mind, however, that these and similar terms are to be associated with the appropriate physical quantities and are merely convenient labels applied to these quantities. Unless specifically stated otherwise, it is appreciated that throughout the description, terms like processing, computing, calculating, determining, displaying, or the like, refer to actions and processes of a computer system, logic, processor, or similar electronic device that manipulates and transforms data represented as physical (electronic) quantities To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995).

While example systems, methods, and so on, have been illustrated by describing examples, and while the examples have been described in considerable detail, it is not the intention of the applicants to restrict or in any way limit scope to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, the representative apparatus, and illustrative examples shown and described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

What is claimed is:

1. A fluid dosing substrate dispenser comprising:

a housing including a base portion, a first fluid reservoir and/or a first fluid reservoir holder configured to removably receive the first fluid reservoir, and a second fluid reservoir and/or a second fluid reservoir holder configured to removably receive the second fluid reservoir;

a substrate advancing mechanism configured to receive substrate from a substrate source and to advance a portion of the substrate through the housing;

an application mechanism configured to apply fluid from at least one of the first fluid reservoir or the second fluid reservoir to one or more portions of the substrate; and a computing system configured to control the application mechanism to apply the fluid and to select at least one of amount of fluid for application, composition of fluid for application, or portion of the substrate the fluid is applied based on an input received by the computing system, wherein the computing system is further configured to control the substrate advancing mechanism to advance the portion of the substrate through the housing based on the input received indicating a user of the substrate dispenser, wherein the input received by the computing system comprises a wireless signal from a transmitter, wherein the substrate dispenser further includes a proximity sensor configured to detect distance of the transmitter to the housing, wherein the computing system is further configured to control the application to apply the fluid when the transmitter is within a threshold distance from the housing.

2. The dispenser of claim 1, wherein the computing system includes a first profile and a second profile, wherein the first profile includes a first predetermined composition of fluid for application, wherein the second profile includes a second predetermined composition of fluid for application, wherein the computing system is further configured to select the first profile or the second profile based on the input received.

3. The dispenser of claim 1, wherein the first fluid reservoir holder includes a sensor configured to detect fluid content of the first fluid reservoir, wherein the second fluid reservoir holder includes a second sensor configured to detect fluid content of the second fluid reservoir.

4. The dispenser of claim 1, wherein fluid in the first fluid reservoir and fluid in the second fluid reservoir are different.

5. The dispenser of claim 1, wherein the housing further includes a third fluid reservoir holder configured to removably receive a third fluid reservoir, wherein the application mechanism is further configured to apply fluid from the third fluid reservoir.

6. The dispenser of claim 1, wherein the computing system is configured to cause the application mechanism to apply fluid from the first fluid reservoir to a first portion of the substrate and to apply fluid from the second fluid reservoir to the first portion of the substrate on top of the fluid from the first fluid reservoir.

7. The dispenser of claim 1, wherein the application mechanism comprises a plurality of nozzles arranged in a dot matrix.

8. The dispenser of claim 1, wherein the portion of the substrate the fluid is applied to is a predetermined pattern.

9. The dispenser of claim 1, wherein the application mechanism includes a fluid conduit to fluidly connect a nozzle to apply fluid to the substrate to the first fluid reservoir and the second fluid reservoir.

10. The dispenser of claim 9, wherein the computing system is further configured to cause a second application mechanism to apply a cleaning fluid to the fluid conduit to flush the fluid conduit after applying the fluid to the substrate.

11. The dispenser of claim 1, further including a substrate separator configured to separate the substrate from a second substrate from the substrate source.

12. The dispenser of claim 1, wherein the housing further includes a portion configured to removably retain the substrate source to allow substrate from the substrate source to be advanced by the substrate advancing mechanism.

13. A fluid dosing substrate dispenser comprising:

a housing including a base portion, a first fluid reservoir and/or a first fluid reservoir holder configured to removably receive the first fluid reservoir, and a second fluid reservoir and/or a second fluid reservoir holder configured to removably receive the second fluid reservoir;

a substrate advancing mechanism configured to receive substrate from a substrate source and to advance a portion of the substrate through the housing;

an application mechanism configured to apply fluid from at least one of the first fluid reservoir or the second fluid reservoir to one or more portions of the substrate; and a computing system configured to control the application mechanism to apply the fluid and to select at least one of amount of fluid for application, composition of fluid for application, or portion of the substrate the fluid is applied based on an input received by the computing system, wherein the computing system is further configured to control the substrate advancing mechanism to advance the portion of the substrate through the housing based on the input received indicating a user of the substrate dispenser, wherein the application mechanism includes a fluid conduit to fluidly connect a nozzle to apply fluid to the substrate to the first fluid reservoir and the second fluid reservoir.

14. The dispenser of claim 13, wherein the computing system is further configured to cause a second application mechanism to apply a cleaning fluid to the fluid conduit to flush the fluid conduit after applying the fluid to the substrate.

* * * * *